US007228078B2

(12) United States Patent
Okochi

(10) Patent No.: US 7,228,078 B2
(45) Date of Patent: Jun. 5, 2007

(54) PRINTING CONTROL DEVICE AND METHOD AND PROGRAM FOR EFFICIENT UTILIZATION OF CONSUMABLE PRODUCTS MOUNTED THEREON

(75) Inventor: Satoshi Okochi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 11/049,707

(22) Filed: Feb. 4, 2005

(65) Prior Publication Data

US 2006/0045546 A1 Mar. 2, 2006

(30) Foreign Application Priority Data

Sep. 1, 2004 (JP) ..... 2004-254414

(51) Int. Cl.
*G03G 15/00* (2006.01)
*G03G 15/08* (2006.01)

(52) U.S. Cl. ..... 399/13; 399/24; 399/26; 399/27

(58) Field of Classification Search ..... 399/13, 399/24, 26, 27
See application file for complete search history.

(56) References Cited

U.S. PATENT DOCUMENTS 4,771,313 A * 9/1988 Kuroda et al. ..... 399/25

FOREIGN PATENT DOCUMENTS

JP 62237478 A * 10/1987
JP A-2001-134064 5/2001
JP A-2002-067450 3/2002

* cited by examiner

*Primary Examiner*—David M. Gray
*Assistant Examiner*—Ryan Gleitz
(74) *Attorney, Agent, or Firm*—Oliff & Berridge, PLC

(57) ABSTRACT

A printing control device, method, system and program with a consumable product detachably mounted thereon, including a state storing unit that stores a usage state of the consumable product, a detachment detecting unit that detects that the consumable product has been detached a usage state checking unit that checks the usage state of the consumable product whose detachment has been detected by the detachment detecting unit based on data stored in the state storing unit a determination unit that determines whether the consumable product is still usable or not based on the usage state checked by the usage state checking unit and a notification unit that notifies that the consumable product is still usable if the determination unit determines that the consumable product is still usable.

12 Claims, 5 Drawing Sheets

PRINTING CONTROL DEVICE AND METHOD AND PROGRAM FOR EFFICIENT UTILIZATION OF CONSUMABLE PRODUCTS MOUNTED THEREON

BACKGROUND OF THE INVENTION

1. Field of the Invention

The present invention relates to a printing control device capable of replacing consumable products and to a method and program for efficient utilization of such consumable products. Particularly, the present invention relates to a printing control device designed to detect detachment of consumable products still usable for avoiding waste of such items, and to a method and program for efficient utilization of consumable product mounted on such device.

2. Description of the Related Art

In general, when the available remaining amount of a consumable product such as toner used in a color printer or the like becomes small or when the time for replacing a drum comes in the near future (the life of a drum is coming to an end), a user is informed of that fact through a notice message displayed on a control panel display or the like.

If, for example, the remaining amount of yellow toner has become small, a notice message of "REPLACE YELLOW TONER" or a graphical display of the remaining amount of toner is shown to prompt users to replace the yellow toner cartridge.

When users are noticed in this manner, they will be able to know only the fact that the available remaining amount of a consumable product has become low. They, however, are unable to know how much amount is still left and usable. Therefore, if the consumable product is replaced following the notice message, the remaining amount of the product still usable will be discarded wastefully, and thus sufficient economical efficiency or maintainability cannot be obtained.

JP 2001-134064A discloses a technique for enabling precise detection of the remaining amount of developer in a development apparatus.

According to the conventional technique disclosed in JP 2001-134064A, it is made possible to notify a user of the proper timing for replacing developer in a development apparatus, by detecting an accurate remaining amount of developer in the device and notifying the user of the remaining amount thus detected. It is therefore possible to prevent image defects such as white specks or waste of developer, which would be caused by erroneous detection of the remaining amount of the developer.

Further, JP 2002-67450A discloses a technique to facilitate maintenance by storing several type of information such as amount of ink used for printing, number of uses of a cutter for cutting a printing medium like paper, number of times of printing with a printing head, and amount of operation of functional parts.

However, according to the conventional technique disclosed in JP 2001-134064, even if the remaining amount of developer can be detected precisely, there is a risk that a user who replaces developer may make a mistake to replace a developer cartridge that does not require replacement. If this happens, the developer erroneously replaced will be wasted.

According to the technique disclosed in JP 2002-67450A, although maintenance operations are facilitated by providing various types of information, there is still a risk that a replaceable functional part might be replaced erroneously. If this happens, such functional part, which will otherwise be still usable, will be wasted.

SUMMARY OF THE INVENTION

The present invention has been made in view of the above circumstances and provides a printing control device designed to detect detachment of consumable products still usable for avoiding waste of such products, and a method and program for efficient utilization of consumable products mounted on such device.

According to an aspect of the present invention, a printing control device having a consumable product detachably mounted thereon, comprises state storing unit that stores a usage state of the consumable product; detachment detecting unit that detects that the consumable product has been detached; usage state checking unit that checks the usage state of the consumable product whose detachment has been detected by the detachment detecting unit, based on data stored in the state storing unit; determination unit that determines whether the consumable product is still usable or not based on the usage state checked by the usage state checking unit; and notification unit that notifies that the consumable product is still usable if the determination unit determines that the consumable product is still usable.

With the above configuration, if a consumable product still usable is detached, this fact is detected and notified to the user. Therefore, an advantageous effect can be obtained that an erroneous replacement of a consumable product still usable is prevented.

Further, identification information of each consumable product is stored, so that if a consumable product still usable is detached, the processing is halted until a consumable product having the same identification information is attached. Therefore, a careless replacement of a consumable product still usable is prevented, thus enabling to utilize consumable products more efficiently.

The present invention is applicable to a processing device in which a consumable product is replaced, and is particularly useful for realizing efficient usage of consumable products such as toner cartridges or drums, by displaying, if a consumable product still usable is detached or replaced, a message indicating that the detached consumable product is still usable, and halting the processing until the detached consumable product is reattached.

BRIEF DESCRIPTION OF THE DRAWINGS

Preferred embodiments of the present invention will be described in detail based on the following figures, wherein.

DESCRIPTION OF THE EMBODIMENTS

Embodiments of a printing control device, method, and program according to the present invention will now be described with reference to the drawings.

Although the present invention is applicable to any devices, as typified by printers or fax machines, which various consumable product can be attached to and detached from, the following description will be made, taking a printer as an example.

Figure 1:
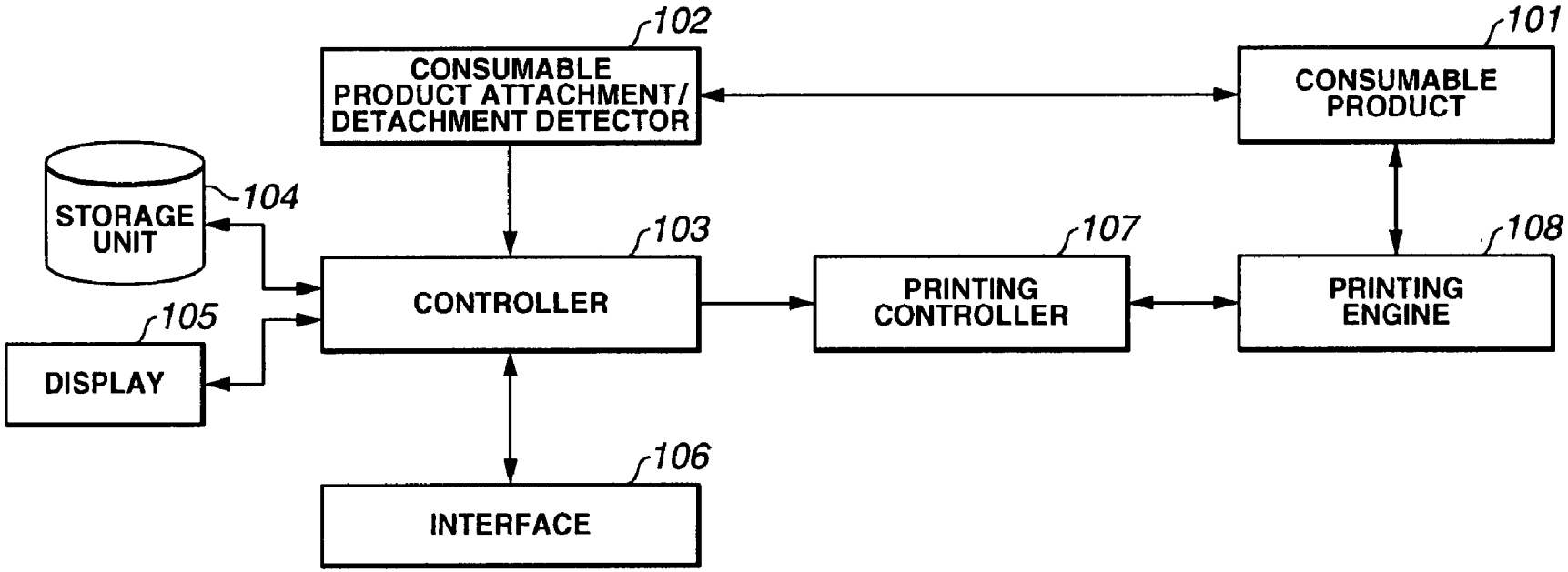
FIG. 1 is a block diagram of a system according to an embodiment and configured by applying a printing control device and a method and program for efficient utilization of consumable products mounted on the device according to the present invention.

First Embodiment:

FIG. 1 is a block diagram of a first embodiment of a system configured by applying a printing control device and a method and program for efficient utilization of consumable products mounted on the device according to the present invention.

Referring to FIG. 1, the printing control device comprises a consumable product 101, a consumable product attachment/detachment detector 102, a controller 103, a storage unit 104, a display 105, an interface 106, a printing controller 107, and a printing engine 108.

The consumable product 101 can be attached to and detached from the printing control device, and may be a toner or a drum.

When the consumable product is a toner, it is possible to calculate an available remaining toner amount, which is an amount of the toner still usable. Whereas, when the consumable product is a drum, it is possible to calculate a frequency of use based on a total number of rotations or the like of the drum. This means that it is possible, according to the present invention, to know how long the consumable product is still usable by calculation depending on the type of the consumable product.

When a printing job is implemented by the printing engine 108, consumable products required by the printing job are provided. For example, a drum for feeding a printing medium, and toners to be transferred on the printing medium fed by the drum are required, and a stapler is required for the printed media to be stapled.

The consumable product attachment/detachment detector 102 detects the detachment of a consumable product in the consumable product 101, and determines what type of consumable product the detached consumable product is. For example, If the toner cartridge of a cyan color has been detached, the detector 102 determines that the detached consumable product is a toner cartridge and the color of the toner is cyan.

Further, when a consumable product still usable is attached, the consumable product attachment/detachment detector 102 detects the attachment and transmits a detection signal to the controller 103.

The controller 103 comprises a CPU (Central Processing Unit) connected to the device and controls the detached consumable product.

The storage unit 104 constantly records "consumption state" which indicates the extent to which a consumable product currently attached has been consumed. If the consumable product attachment/detachment detector 102 has detected the detachment of the consumable product whose "consumption state" has been recorded, the "consumption state" of the detached consumable product that has been recorded last is acquired from the storage unit 104, and a "consumption state" according to the type of the consumable product is determined.

For example, if the consumable product is a toner cartridge, the controller 103 determines whether the "consumption state" of the toner cartridge is completely empty. If the consumable product is a drum, the controller 103 checks the total number of rotations of the drum at the time when the drum was detached. If the total number of rotations has exceeded a predetermined number of rotations, it is determined that the drum is not usable any more.

The storage unit 104 then records the fact that the consumable product has been detached. As the result, the storage unit 104 is not required to monitor the "consumption state" of the detached consumable product any more.

If the "consumption state" of a detached consumable product (toner cartridge or drum) that has been recorded last is that the toner cartridge is not empty yet, or that the total number of rotations of the drum has not exceeded the predetermined number of rotations, it is determined that the consumable product has been detached in a still usable state.

Conversely, if the consumable product attachment/detachment detector 102 detects the attachment of the detached consumable product, the storage unit 104 is updated.

The storage unit 104 comprises an EEPROM (Electrically Erasable Programmable Read-Only Memory) or the like that is electrically rewritable, and stores data on what consumable products are attached to the device while, at the same time, storing the "consumption state" for each of the consumable products. If any of the stored consumable products is detached from the device, the storage unit 104 stores the fact that the consumable product has been detached. The "consumption state" may be stored by checking the state of each consumable product at certain intervals, or by recording the state whenever there is a change in the state of the consumable product.

The display 105 comprises an LCD (Liquid Crystal Display) installed on a printer or the like. If the controller 103 determines that a consumable product has been detached in a still usable state, the display 105 displays an alarm message that a still usable consumable product has been detached. On the other hand, if the detached consumable product is not usable any more, the display 105 displays a message that the detachment has been done normally.

The detachment of a still usable consumable product may be notified by way of a network. For example, electronic mail technology and MIB (Management Information Base), that is an aggregate of and information on equipment to be monitored, can be used.

The interface 106 serves as a contact to inform an external host computer of the state of consumable products, and at the same time to receive a print request therefrom, and comprises a USB (Universal Serial Bus) interface, network interface, or parallel interface.

The printing controller 107 performs controls in printing jobs.

The printing engine 108 receives a process request from the printing controller 107 and performs image formation processing for forming an image to be printed out. The consumable product 101 is used to form the image in the image formation processing.

According to the arrangement as described above, even if a consumable product still usable is detached as a result of a user's erroneous operation or the like, it is possible to inform the user that the detached product is still usable. The user thus becomes aware of his/her error and can reattach the product.

Figure 2:
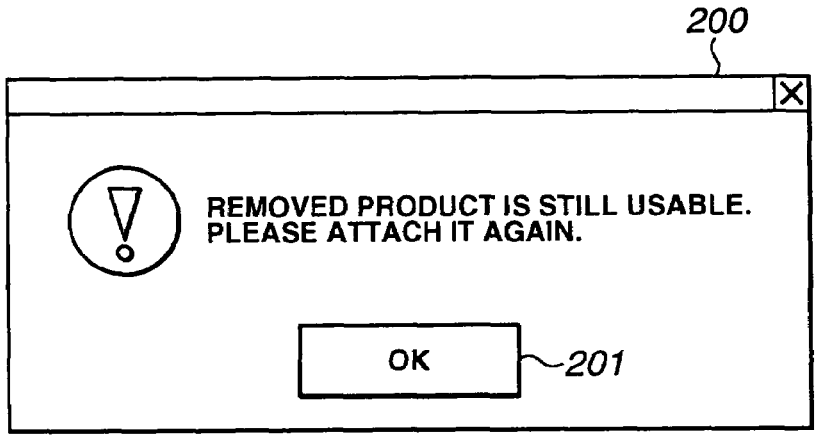
FIG. 2 shows a display screen displaying a message to prompt a user to reattach the consumable product.

FIG. 2 shows a screen displaying a message to prompt a user to reattach the consumable product.

The screen that is shown in FIG. 2 is displayed on the display 105 shown in FIG. 1 when a consumable product still usable has been detached.

Figure 3:
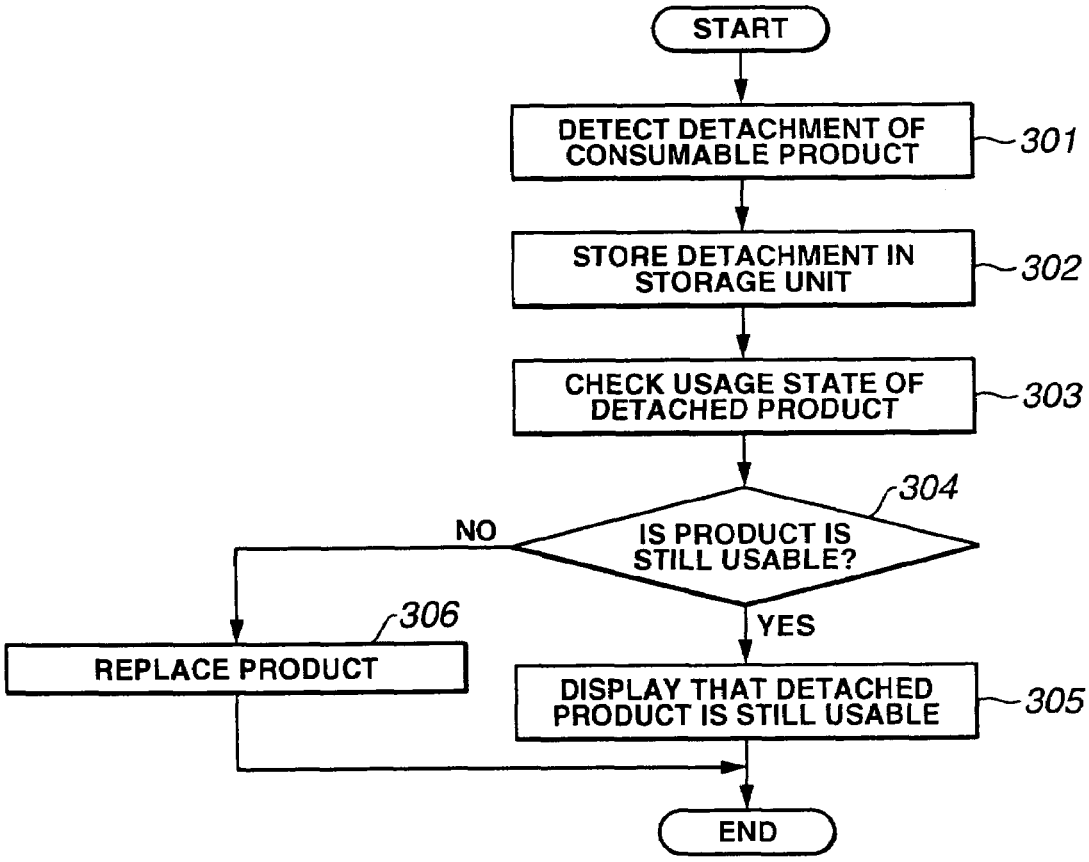
FIG. 3 is a flowchart showing the flow of processing implemented when a consumable product has been detached.

FIG. 3 is a flowchart showing the flow of processing implemented when a consumable product has been detached.

Referring to FIG. 3, the processing is started upon detection of the detachment of a consumable product which is detachably attached to the device (S301). The type of the detached consumable product is identified and the fact that this consumable product is detached is stored in the storage unit 104 shown in FIG. 1 (S302). Then, the usage state of the consumable product whose detachment is stored is checked (S303). For example, if the consumable product is a toner cartridge, the available remaining amount of the toner is checked. If the consumable product is a drum, the total number of rotations of the drum stored immediately before the detachment is checked.

Then, it is determined whether the consumable product thus checked is still usable or not (S304). If it is still usable (YES in S304), a message indicating that the detached consumable product is still usable is displayed (S305). On the other hand, if the product is not usable any more (NO in S304), it is determined that the detached consumable product is to be replaced, and a replacement is implemented (S306).

According to this method, it is possible to prevent the replacement of a still usable consumable product by an erroneous operation, whereby consumable products can be used efficiently.

Figure 4:
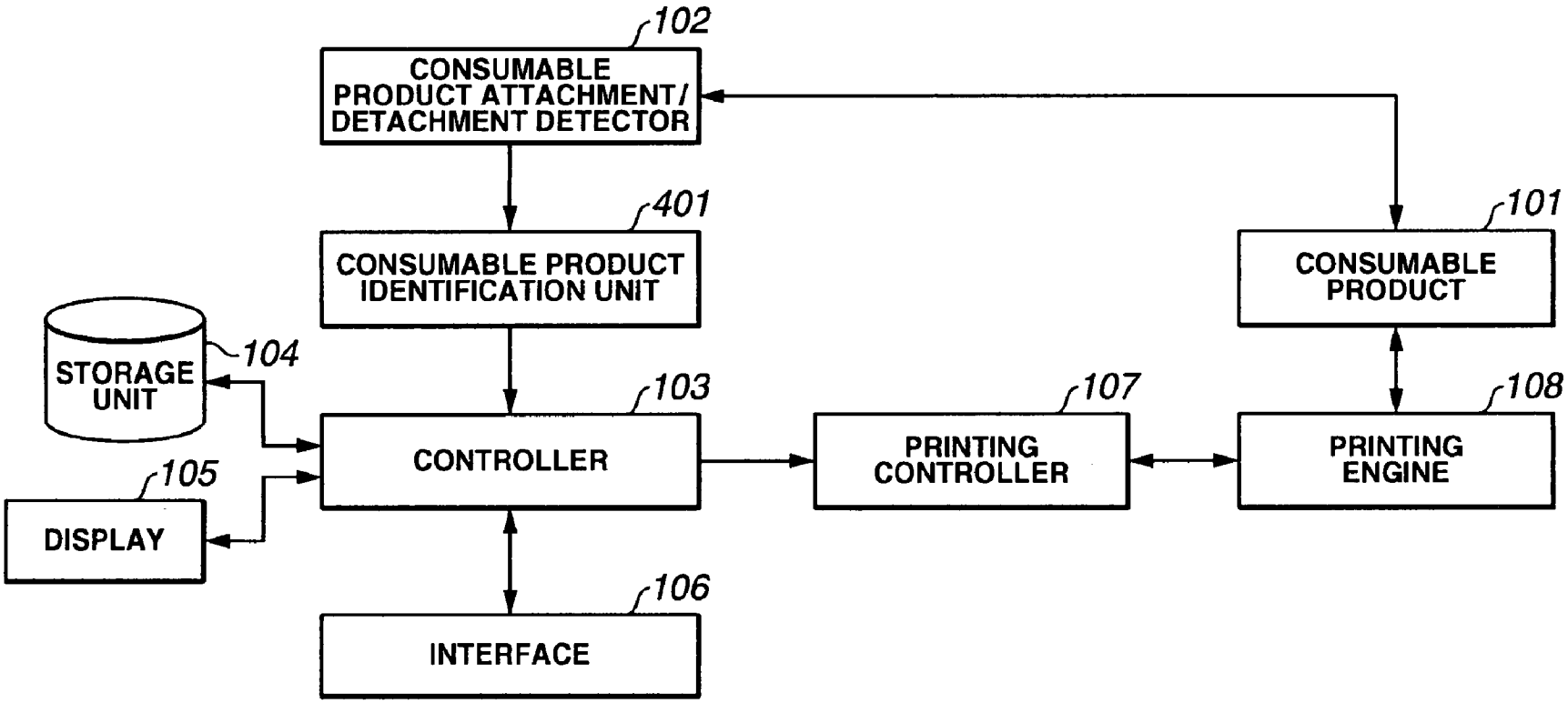
FIG. 4 is a block diagram of a system according to another embodiment and configured by applying a printing control device and a method and program for efficient utilization of consumable products mounted on the device according to the present invention.

Second Embodiment:

FIG. 4 is a block diagram of a second embodiment of a system configured by applying a printing control device and a method and program for efficient utilization of consumable products mounted on the device according to the present invention.

Referring to FIG. 4, the printing control device comprises a consumable product 101, a consumable product attachment/detachment detector 102, a controller 103, a storage unit 104, a display 105, an interface 106, a printing controller 107, a printing engine 108, and a consumable product identification unit 401.

The printing control device shown in FIG. 4 has a substantially identical system configuration to that of the device in FIG. 1, except the consumable product identification unit 401. Therefore, the following description will be made principally on those parts different from the system configuration shown in FIG. 1.

The consumable product 101 is detachably attached to the device. Each consumable product can be assigned with an identifier (hereafter to be referred to as "consumable product ID").

The consumable product attachment/detachment detector 102 detects the attachment of a consumable product assigned with a consumable product ID and also detects the detachment thereof The consumable product identification unit 401 is capable of identifying a consumable product whose attachment or detachment is detected by the consumable product attachment/detachment detector 102. In other words, the consumable product identification unit 401 is capable of uniquely identifying a consumable product which has been attached or detached.

For example, if a detached consumable product is a toner cartridge of a magenta toner and a toner cartridge replaced is a different toner cartridge of the same magenta toner, the consumable product identification unit 401 determines that a different consumable product has been attached because the replaced consumable product is the same type as the detached one but not exactly identical to the detached one. In other words, the consumable product identification unit 401 does not determine that an identical product has been attached unless the detached consumable product itself is attached.

In the second embodiment, in addition to the processing described in relation to FIG. 1, the controller 103 compares a consumable product ID of a detached consumable product identified by the consumable product identification unit 401 with a consumable product ID assigned to each consumable product and stored in the storage unit 104. If it is found that they are the same consumable product ID, then the controller 103 implements normal processing. Whereas, if they are different, the controller 103 displays a message to prompt the user to attach a consumable product with the same consumable product ID. In the meantime, the processing is halted until a consumable product with the same consumable product ID is attached.

In addition to the processing described in relation to FIG. 1, the storage unit 104 stores a consumable product ID assigned to each consumable product attached to the device.

The display 105 displays that a consumable product has been detached. If the detached consumable product is still usable and another consumable product attached in replacement does not have the same consumable product ID, the display 105 displays a message to prompt the user to attach the same consumable product that has been detached.

Configuration may be such that the massage is stored in the storage unit 104 instead of being displayed.

According to such configuration, it is possible to prevent the careless replacement of consumable products still usable, which enables more efficient and economical usage of consumable products. It is also possible to prevent the attachment or detachment of consumable products caused by erroneous operations.

Figure 5:
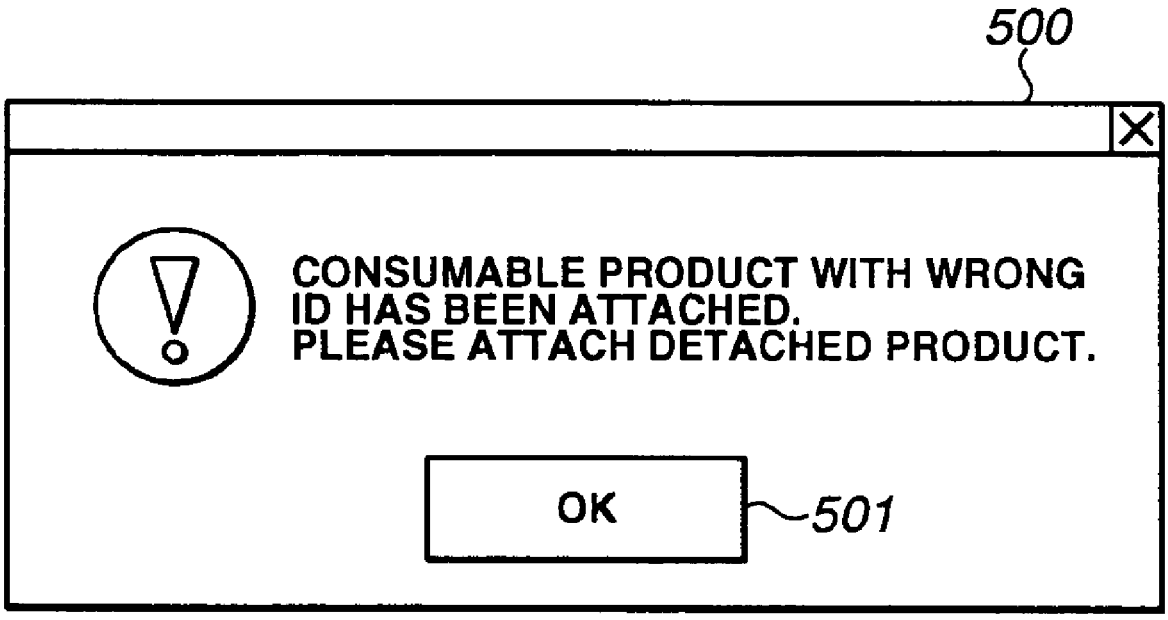
FIG. 5 shows a display screen displaying a message to prompt a user to attach a consumable product with a same consumable product ID as that of the detached one.

FIG. 5 shows a screen displaying a message to prompt the user to attach a consumable product having the same consumable product ID as that of the detached one.

Referring to FIG. 5, the screen is displayed when consumable product IDs are different between the detached consumable product and the attached consumable product.

When an OK button 501 is pressed, the processing is again implemented to compare the consumable product ID of a newly attached consumable product with that of the detached consumable product.

Figure 6:
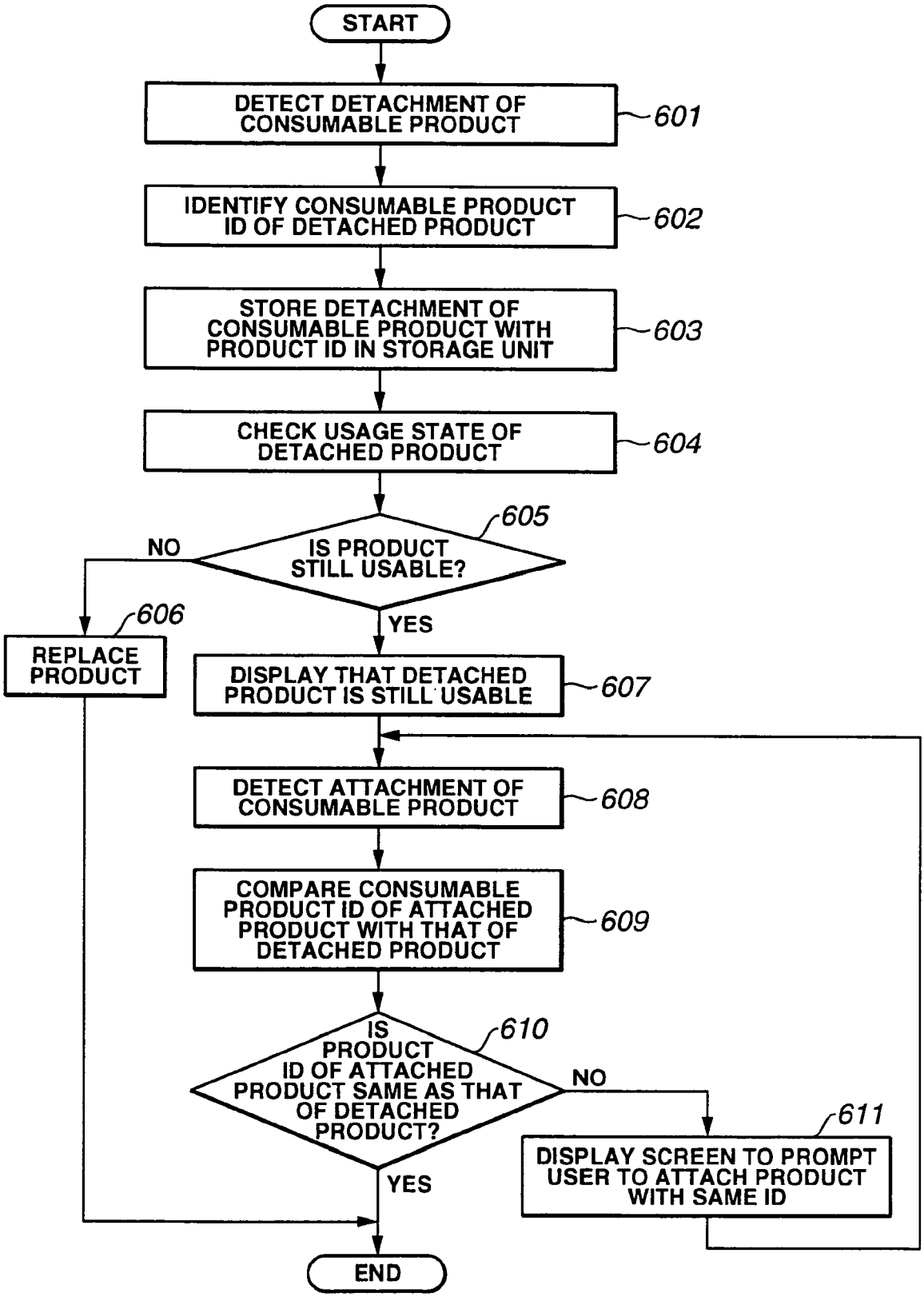
FIG. 6 is a flowchart showing another example the flow of processing implemented when a consumable product has been detached.

FIG. 6 is a flowchart showing another example of the flow of processing implemented when a consumable product has been detached.

Referring to FIG. 6, the processing is initiated upon detachment of a consumable product that is detachably attached to the device, and the detachment of the consumable product is detected (S601). The consumable product ID of the detached consumable product is identified as the consumable product ID stored in the storage unit 104 shown in FIG. 1 (S602). The detachment of the consumable product having the consumable product ID is recorded in the storage unit 104(S603), and the usage state of the consumable product whose detachment has been recorded is checked (S604). The checking of the usage state is implemented in the same manner implemented in the usage state checking processing described above in relation to FIG. 3.

Having checked the usage state of the detached consumable product, it is determined whether or not the product is still usable (S605). If it is determined that the product is not usable any more (NO in S605), it is determined that the detached consumable product requires a replacement, and the processing for replacement is performed (S606). On the other hand, if it is determined that the detached product is still usable (YES in S605), a screen is displayed to notify that the detached consumable product is still usable (S607).

In the meantime, the processing is halted until the consumable product that has been detached is attached.

When the attachment of the detached consumable product is detected (S608), the consumable product ID identified at the time of the detachment is compared with the consumable product ID of the attached consumable product (S609). As a result of such comparison, it is determined whether or not the consumable product ID of the attached consumable product is the same as that of the detached consumable product (S610). If it is determined that they are not the same (NO in 610), then a message is displayed to prompt the user to attach a consumable product with the same consumable product ID as that of the detached one (S611). On the other hand, if they are the same (YES S610), then it is determined that the detached consumable product has been properly reattached to the device, and the processing is completed.

In the above-described manner, it is ensured that a consumable product can be used until it becomes unusable.

According to the processing as described above, the printing control device of the present invention is capable of preventing a consumable product still usable from being replaced by error.

It is thus enabled to utilize consumable products efficiently.

It should be noted that the processing shown in the flowcharts above may be implemented by a printing control program which can be executed by a computer.

The present invention is not limited to the embodiments as described above and shown in the drawings, but various changes and modifications may be made without departing from the spirit of the invention.

What is claimed is:

1. A printing control device having a consumable product detachably mounted thereon, comprising:

a state storing unit that stores a usage state of the consumable product;

a detachment detecting unit that detects that the consumable product has been detached;

a usage state checking unit that checks the usage state of the consumable product whose detachment has been detected by the detachment detecting unit, based on data stored in the state storing unit;

a determination unit that determines whether the consumable product is still usable or not based on the usage state checked by the usage state checking unit; and a notification unit that notifies that the consumable product is still usable if the determination unit determines that the consumable product is still usable.

2. The printing control device according to claim 1, wherein, if another consumable product is attached in place of the detached consumable product that is still usable, the notification unit provides a notification to prompt a user to reattach the detached consumable product still usable.

3. The printing control device according to claim 1, wherein the notification unit provides the notification by way of a network.

4. The printing control device according to claim 3, wherein the notification unit provides the notification by way of an electronic mail.

5. The printing control device according to claim 3, wherein the notification is provided based on Management Information Base.

6. The printing control device according to claim 1, wherein the notification unit provides the notification by means of an alarm sound.

7. The printing control device according to claim 1, wherein the notification unit provides the notification by means of a display unit installed on the printing control device.

8. The printing control device according to claim 1, wherein, when the consumable product is a toner, the state storing unit stores an available remaining amount thereof.

9. The printing control device according to claim 1, wherein, when the consumable product is a drum, the state storing unit stores a total number of rotations that the drum has made to present.

10. A printing control method for a device having a consumable product detachably mounted thereon, comprising:

storing a usage state of the consumable product in a state storing unit;

detecting that the consumable product has been detached by a detachment detecting unit;

checking the usage state of the consumable product detected by the detachment detecting unit by a usage state checking unit based on data stored in the state storing unit;

determining by a determination unit whether the consumable product is still usable based on the usage state checked by the usage state checking unit; and notifying that the consumable product is still usable when the determination unit determines that the consumable product is still usable.

11. A printing control system, comprising:

a state storing unit that stores a usage state of the consumable product;

a detachment detecting unit that detects that the consumable product has been detached;

a usage state checking unit that checks the usage state of the consumable product whose detachment has been detected by the detachment detecting unit, based on data stored in the state storing unit;

a determination unit that determines whether the consumable product is still usable or not based on the usage state checked by the usage state checking unit; and a notification unit that notifies that the consumable product is still usable if the determination unit determines that the consumable product is still usable.

12. A computer-readable medium containing a program for instructing a computer system to execute a method for printing control, the method comprising:

storing a usage state of the consumable product in a state storing unit;

detecting that the consumable product has been detached by a detachment detecting unit;

checking the usage state of the consumable product detected by the detachment detecting unit by a usage state checking unit based on data stored in the state storing unit;

determining by a determination unit whether the consumable product is still usable based on the usage state checked by the usage state checking unit; and notifying that the consumable product is still usable when the determination unit determines that the consumable product is still usable.

* * * * *